US006779910B1

(12) United States Patent
Pelton

(10) Patent No.: US 6,779,910 B1
(45) Date of Patent: Aug. 24, 2004

(54) FLUORESCENT DOWNLIGHT WITH OPTIMIZED DISTRIBUTION

(76) Inventor: Bruce Pelton, 29432 Troon St., Laguna Niguel, CA (US) 92677

( * ) Notice: Subject to any disclaimer, the term of this patent is extended or adjusted under 35 U.S.C. 154(b) by 0 days.

(21) Appl. No.: 10/243,814

(22) Filed: Sep. 13, 2002

Related U.S. Application Data

(60) Provisional application No. 60/318,813, filed on Sep. 13, 2001.

(51) Int. Cl.[7] ..... F21V 17/00

(52) U.S. Cl. ..... 362/364; 362/365; 362/260; 362/269

(58) Field of Search ..... 362/260, 217, 362/269, 265, 297, 145, 146, 148, 150, 364, 372

(56) References Cited

U.S. PATENT DOCUMENTS

| | | | | |
|---|---|---|---|---|
| 3,899,712 A | | 8/1975 | Whitting | |
| 4,520,436 A | * | 5/1985 | McNair et al. | 362/366 |
| 4,947,297 A | * | 8/1990 | Druffel et al. | 362/147 |
| 5,073,845 A | | 12/1991 | Aubrey | |
| 5,320,547 A | | 6/1994 | Mews et al. | |
| 5,355,290 A | * | 10/1994 | Tickner | 362/294 |
| 5,491,618 A | | 2/1996 | Vakil | |
| 5,528,473 A | * | 6/1996 | Kassay et al. | 362/247 |
| 5,535,110 A | | 7/1996 | Ling | |
| 5,707,143 A | | 1/1998 | Hentz | |
| 5,931,567 A | * | 8/1999 | Salzmann et al. | 362/304 |
| 5,967,640 A | * | 10/1999 | Moriyama et al. | 362/147 |
| 6,059,424 A | * | 5/2000 | Kotloff | 362/220 |
| 6,168,299 B1 | | 1/2001 | Yan | |
| 6,350,046 B1 | * | 2/2002 | Lau | 362/364 |
| 6,452,336 B1 | * | 9/2002 | Dandu | 315/56 |
| 6,457,848 B1 | * | 10/2002 | Wolf et al. | 362/364 |

* cited by examiner

*Primary Examiner*—Thomas M. Sember
*Assistant Examiner*—Hargobind S. Sawhney
(74) *Attorney, Agent, or Firm*—Joseph H. Taddeo

(57) ABSTRACT

A recessed light fixture with body, reflector and electrical box formed as one piece, preferably of a polymeric material. The fixture includes a self-mounting feature and a seal against air infiltration into unconditioned spaces. The reflector has special geometry that provides symmetrical distribution of light. The lamp socket tilts downward to facilitate lamp changes. The design moves the heat sensitive components of the electronic ballast far from the heat produced by the lamp. The fixture may be installed from the occupied side of the room, eliminating the need for an installer to crawl in attic spaces.

17 Claims, 11 Drawing Sheets

FLUORESCENT DOWNLIGHT WITH OPTIMIZED DISTRIBUTION

REFERENCE TO PREVIOUSLY FILED APPLICATIONS

This patent application is a continuation of and claims priority from U.S. Provisional patent application No. 60/318,813 filed on Sep. 13, 2001.

FIELD OF THE INVENTION

The present invention generally relates to a novel fluorescent downlight for use in recessed lighting applications wherein a recessed light fixture with a body, reflector and electrical box are formed in one piece and fabricated of a polymeric material, and more particularly, to a novel fluorescent downlighted lighting fixture using a compact fluorescent lamp and its associated electronic ballast.

BACKGROUND OF THE INVENTION

Compact Fluorescent Lamps (CFL's) are very energy efficient and long lived. They provide almost five times as much light as ordinary incandescent bulbs and last ten times as long. Their size, form factor and distribution make their use in recessed downlighted fixtures more difficult. CFL's are longer, more oblong and have flux patterns that are not symmetrical. If the lamp is used in a vertical orientation the length makes it difficult to allow the resultant fixture to fit in the shallow ceiling cavity between the roof joists where fixtures of this type are often installed. If the lamp lays horizontally light distribution is usually an oval shape making it difficult to design an installation with even distribution of light.

Existing downlight fixtures are normally formed of different metal assemblies. The gaps created by the mating of these disparate pieces forms cavities allowing conditioned air from the occupied spaces to leak into the ceiling cavity and through the roofing system.

When the lamp burns out in typical horizontal fixtures the user must gain access to the fixture, grasp the glass envelope of the lamp and pull it first one way and then the other before tilting it out of the fixture. The process must then be reversed with the new lamp. All the tugging and tilting frequently leaves the user with a handful of shattered glass.

Metallic downlighted fixtures are prone to deterioration when used in damp locations such as in kitchens, baths or in exterior lighting.

The following prior art discloses the various aspects in the design and use of downlighted fluorescent fixtures.

U.S. Pat. No. 3,899,712, granted Aug. 12, 1975, to H. L. Whitting, discloses a tapered helical compact fluorescent lamp, comprising a tapered cylindrical envelope having a helically shaped channel of non-uniform pitch, thereby providing a discharge path circumferentially around the envelope with a pair of electrodes disposed at each end of the discharge path. The interior surface is coated with a luminescent material and its interior chamber is filled with an ionizable gas.

U.S. Pat. No. 5,073,845, granted Dec. 17, 1991, to T. R. Aubrey, teaches a retrofit unit for replacing conventional incandescent light bulbs with fluorescent or similar light sources. A hard-wired ballast is used in conjunction with conventional light fixtures to permit retrofit conversion.

U.S. Pat. No. 5,320,547, granted Jun. 14, 1994, to H. P. Mews, et al., discloses a lamp socket for a fluorescent lamp that permits insertion and removal of a fluorescent lamp in and from a socket, the socket being formed within a body and having an engagement surface wall from which a shelf projects.

U.S. Pat. No. 5,535,110, granted Jul. 9, 1996, to G. Ling, discloses a ceiling mounted, recessed, wallwash light fixture includes a reflector having an internal reflecting surface. A wallwash segment of that reflecting surface is defined by vertically adjacent reflecting faces each arranged so that an effective lowest point of brightness seen by the reflecting face is reflected along a line passing below an opposing portion of a bottom edge of the reflector. The wallwash segment can be defined by an insert attached to the reflecting surface.

U.S. Pat. No. 5,401,618, granted Feb. 13, 1996, to U. Vakil, teaches of a quick connect/disconnect light fixture that requires no tools to install or remove after the initial installation. The disclosed light fixture enables a typical consumer to convert a traditional incandescent light fixture to a fluorescent light fixture and to maintain the light fixture after it is installed.

U.S. Pat. No. 5,707,143, granted Jan. 13, 1998, to J. A. Hentz, teaches of a pull-on clip that is manually assembled to a downlighting reflector trim in a snap-fitting manner. The pull-on clip facilitates positive lamp positioning, thereby providing a clean appearance.

U.S. Pat. No. 6,168,299, granted Jan. 2, 2001, to E. Yan, teaches of a novel energy efficient recessed downlighted lighting fixture, using a compact laterally twisted, fluorescent lamp, and electronic ballast that provides an easy-to-install procedure for retrofit installations. Using an integrated socket-and-ballast subassembly, the overall height is reduced so that it can find use with existing metal housings. This recessed fixture uses a newly designed energy efficient compact fluorescent lamp as the primary lighting source. The compact fluorescent lamp comprises a laterally twisted tube, more commonly referred to as a "SpringLamp" allows the shortest lamp known to the fluorescent lamp industry to be used. It provides for minimal light trapping, thereby creating the maximum concentrated lighting output, and lighting distribution that is closest to the illumination supplied by an incandescent bulb. The laterally twisted "SpringLamp" is centrally positioned at the focal point of the parabolically shaped portion of the reflector to produce a collimated-like downlighted column of concentrated light that enhances the illumination efficiency when measured at the at the central portion of the beam.

The prior art recited above does not teach of the novel advantages that are found in the present invention.

Accordingly, it is therefore an object of the present invention to provide a recessed downlight fixture comprised of a polymeric material that is formed into a single piece incorporating the fixture body, reflector and electrical junction box.

It is another object of the present invention to provide a recessed downlight fixture that utilizes a compound convoluted polymeric reflector system molded as part of the fixture which provides symmetrical light distribution from an asymmetrical source.

It is still another object of the present invention to provide a recessed downlight fixture that provides a lamp retaining means with tilting mechanism to unlatch from normal operation position and reorient downward to allow the user to easily remove and replace the lamp.

It is still yet another object of the present invention to provide a recessed downlight fixture containing a connected electrical junction box, which provides a means of mounting the ballast away from the compact fluorescent lamp to preserve the ballast remote from a thermal load created by the lamp.

It is yet still another object of the present invention to provide a recessed downlight fixture containing an integral reflector and a decorative trim system, which completes the optical elements of the fixture.

An additional object of the present invention is to provide a recessed downlight fixture, whose decorative trim/optical element mounts by having flanges that rotatively engage other flanges on the fixture body.

Still an additional object of the present invention is to provide a recessed downlight fixture, whose decorative trim/optical element mounts by engagement of flexible plastic snaps, which engage to recesses on the fixture body.

Still yet an additional object of the present invention is to provide a recessed downlight fixture that utilizes an air leakage barrier, which is received into slots in the electrical junction box.

One additional object of the present invention is to provide a recessed downlight fixture that utilizes an air leakage barrier, which is received into slots in the electrical junction box that also serves to connect wires within said electrical junction box.

A final object of the present invention is to provide a recessed downright fixture that utilizes an electrical junction box cover, which requires no fasteners to open or close as it permits access within said electrical junction box.

These, as well as other objects and advantages of the present invention will be better understood and appreciated upon reading the following detailed description of the preferred embodiment and it's alternative embodiments when taken in conjunction with the accompanying drawings.

SUMMARY OF THE INVENTION

The present invention solves the shortcomings of current fixtures in a number of unique ways. By forming the reflector, fixture body and junction box from a single injection molded piece, air leaks are prevented.

The junction box extends from the side of the can and provides a mounting site for the lamp socket assembly and a means of conveying the associated wiring back to the ballast. An air dam straddles the wires retaining them in place and preventing leakage of conditioned room air into the unoccupied spaces. The ballast mounts on the outer edge of the junction box as far as possible from the lamp-generated heat while still being a contiguous part of the assembly.

The lamp with a lengthwise axis is installed on the fixture's longitudinal axis, which is collinear with an essentially horizontal axis thereof, providing a low profile for the fixture that is shallow enough to fit in between even six-inch ceiling joists. The reflector employs a series of asymmetrical interlocking convolutions to reshape the intrinsic flux from the lamp into a symmetrical beam that allows the fixture to be installed at any rotation relative to the room. The lamp retaining assembly latches in the normal operating position but can tilt at a downward angle to allow easy lamp replacement. The junction box provides removable pieces for placement of connection wires. The can body has four mounting dogs which automatically deploy when tightened. The installer does his work from the occupied side of the space.

The polymeric construction of the fixture eliminates deterioration from rust and corrosion. The internal reflector is made from a robust, easily cleaned material.

DETAILED DESCRIPTION OF THE INVENTION

Figure 1:
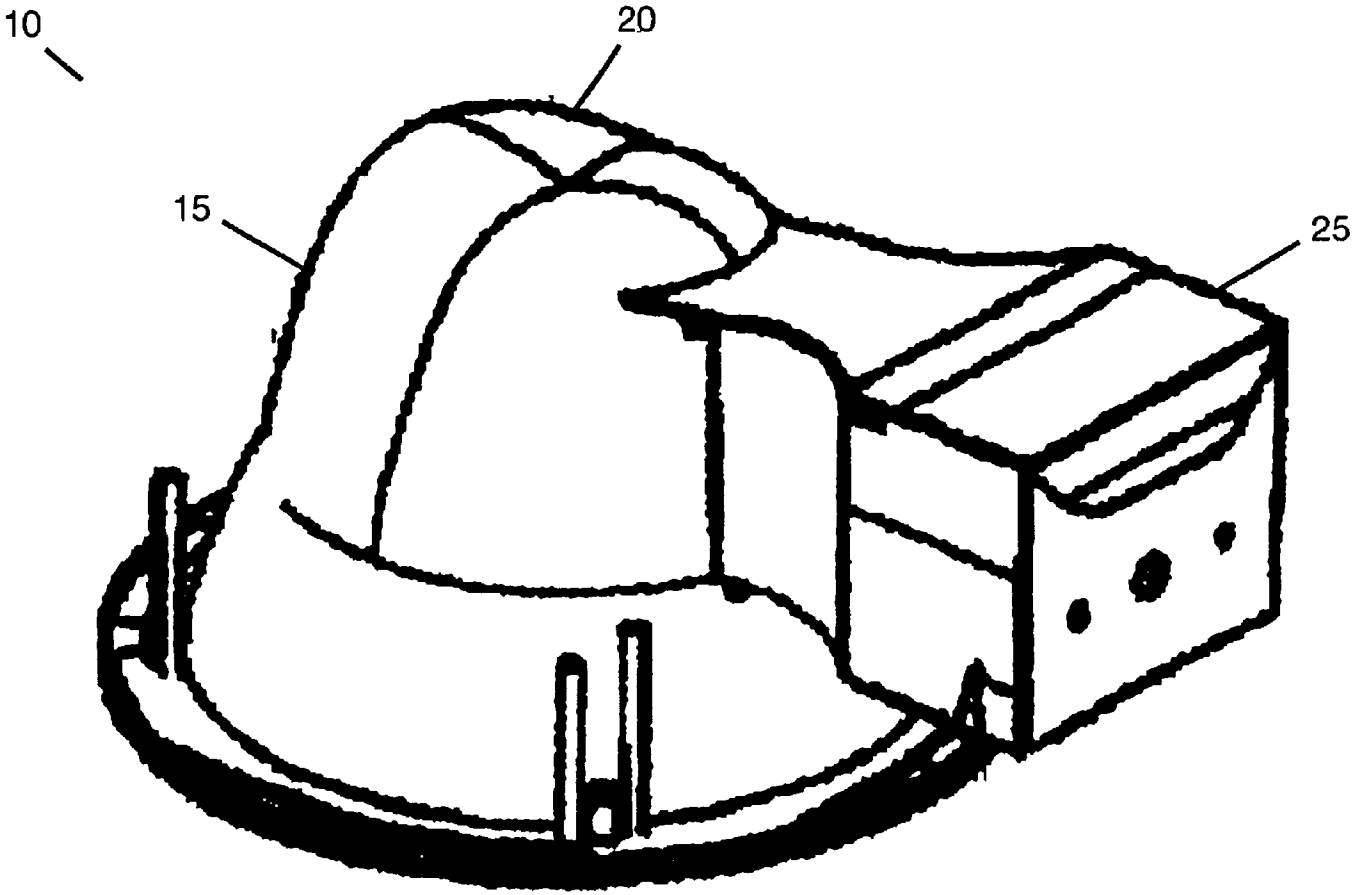
FIG. 1 is a perspective view of the preferred embodiment of the fixture assembly.
Figure 2:
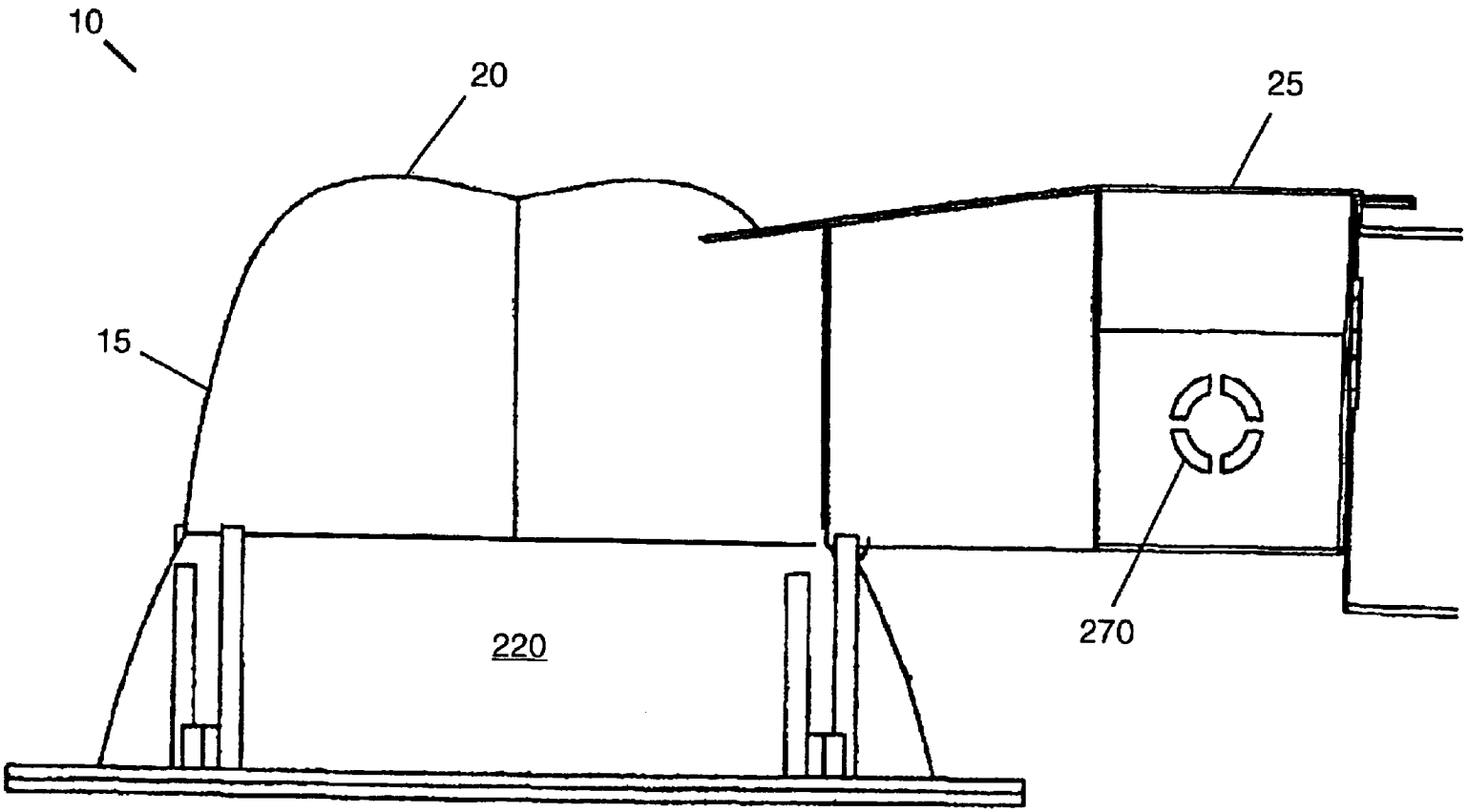
FIG. 2 is a side view of the fixture showing its attached reflector and electrical junction box.

Referring to FIGS. 1 and 2, the unitized recessed lighting fixture 10 is molded in one piece at one time, comprising the can body 15, the reflector 20 and the electrical junction box 25. The reflector 20, the body 15 of the fixture, and the electrical junction box 25 are in a linear arrangement to achieve a horizontal, shallow installation or configuration. And, the can body 15, reflector 20 and junction box 25 are formed from a single injection molded piece, and preferably fabricated of a polymeric material, for an air-tight configuration. By forming the unitized lighting fixture in one piece, air leaks are thereby prevented. During the winter season, heated room air is prevented from escaping into the surrounding ambient spaces; and during the summer season, intrusion of hot air from the attic space into an air-conditioned room is prevented.

As shown in FIGS. 3, 3A, 3B and 4, the can body 15 is positioned over the extension ring 220 with the locking bosses 230 aligned with the receivers 240. The two assemblies are then pressed together and seated while having the locking bosses engage with their respective locking boss receiver.

Turning now to FIGS. 5, 5A, 5B and 5C, the lamp socket 120 is mounted to the lamp bracket 130 by securing it with heat stakeable mounting pins 140 or as an option, securing with retainer pins 145.

Figure 6:
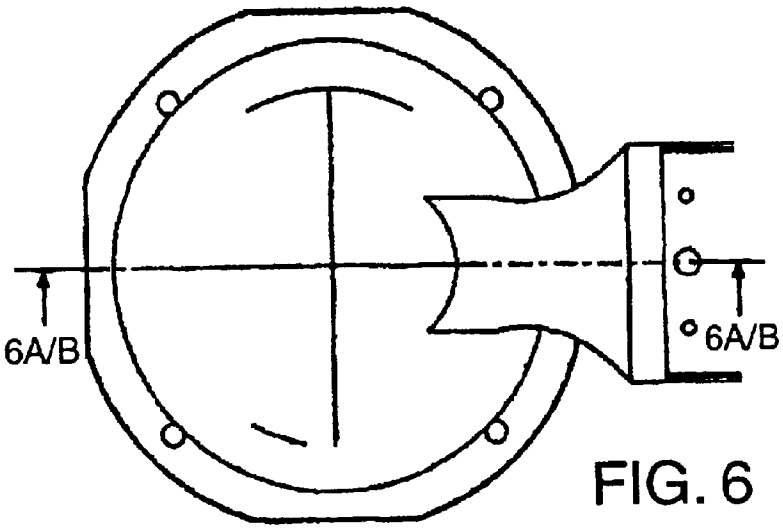
FIG. 6 is a top view of the unitized lighting fixture 10 showing the sectional lines of 6A—6A and 6B—6B.
Figure 6B:
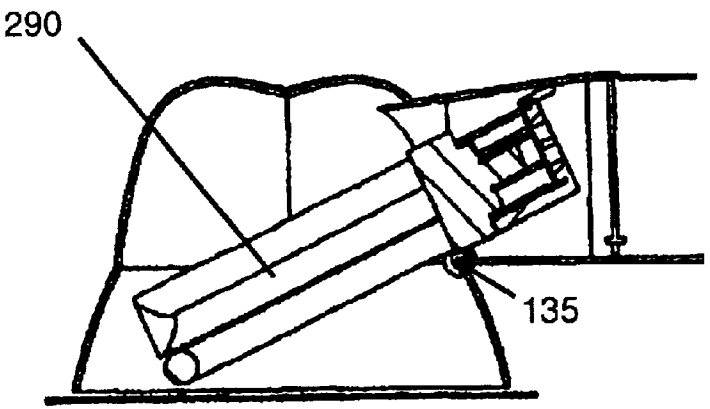
FIG. 6B is a sectional view taken along line 6B—6B of FIG. 6 depicting the lamp socket assembly in a tilted orientation for allowing ease of lamp insertion or replacement.
Figure 6C:
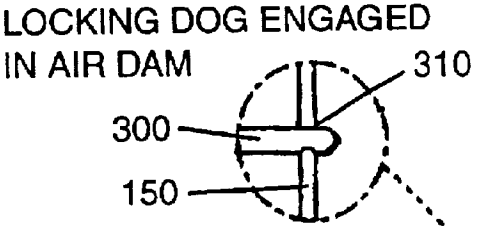
FIG. 6C depicts an enlarged detailed view of the locking dog 300 engaged in the air dam 150, as shown in the sectional drawing of FIG. 6A.
Figure 6A:
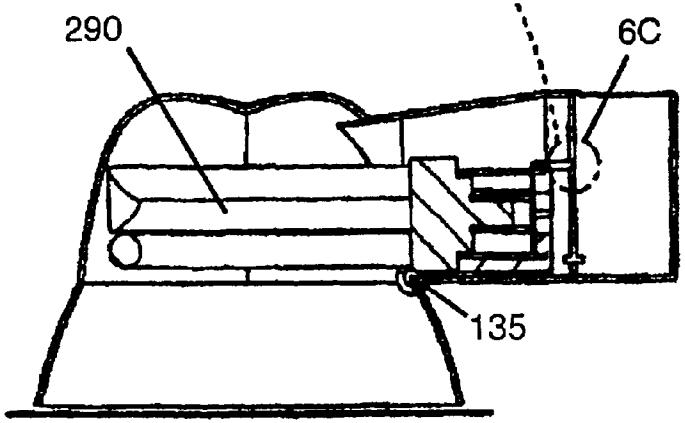
FIG. 6A is a sectional view taken along line 6A—6A of FIG. 6 depicting the lamp socket assembly in the normal locked operating position.

FIGS. 6, 6A and 6B illustrate the lamp retaining assembly that can be positioned in its normal operating position, as shown in FIG. 6A or for ease of replacement of lamp 290, the lamp retaining assembly can be tilted downward, as shown in FIG. 6B. Then lamp socket 120 and lamp socket bracket 130 comprise the lamp retaining assembly.

Figure 11C:
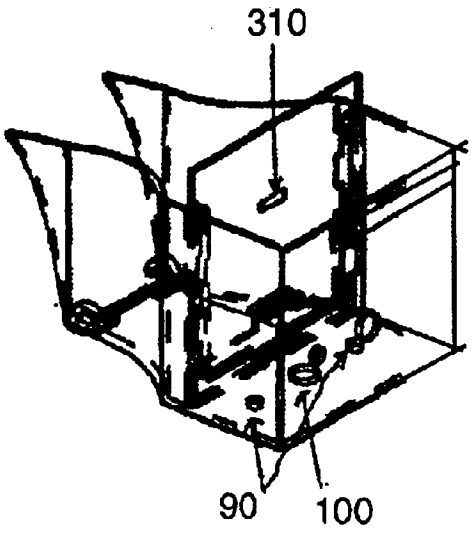
FIG. 11C is a perspective view of the air dam.

The lamp 290 is maintained in its locked horizontal position by engaging locking dog 300 into air dam 150. This is accomplished by rotating the lamp bracket 130 in an upward direction to return the lamp assembly to the horizontal position where it then latches with the snap arm 300 that is interlocked into the receiving slotted aperture 310 in the air dam 150 (as shown in FIG. 11C).

Figure 3:
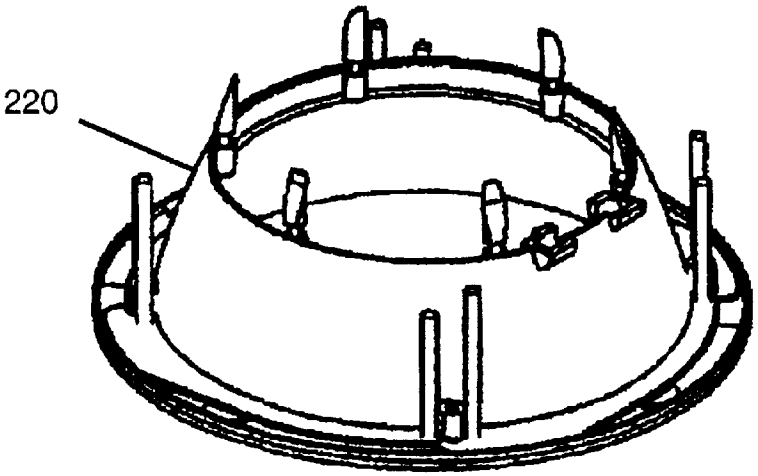
FIG. 3 is a perspective view of the extension ring that provides a mounting flange for the trim system.
Figure 3B:
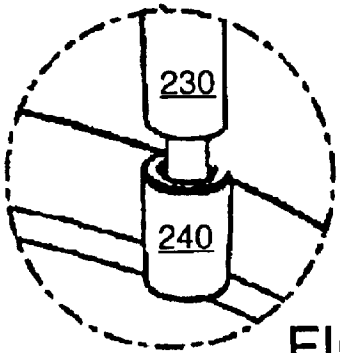
FIG. 3B depicts an enlarged detailed view of the mounting posts joining with the mounting post receivers of the fixture assembly of FIG. 4A.
Figure 3A:
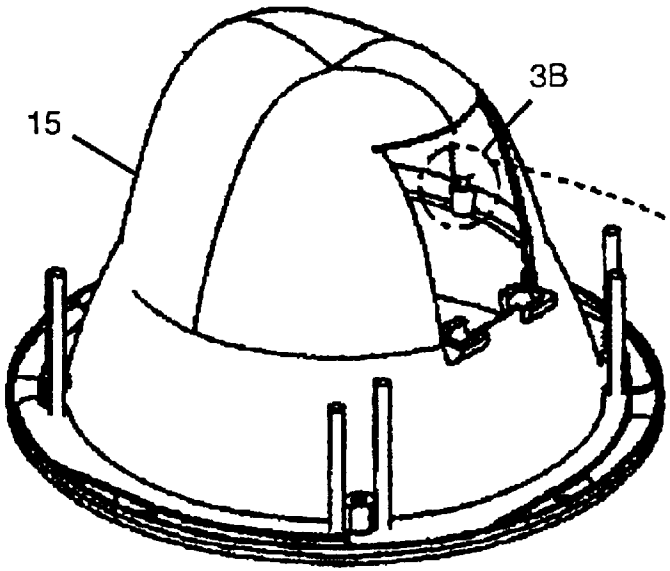
FIG. 3A is a perspective view of the fixture assembly that details the joining means comprising the mounting post receivers.
Figure 7:
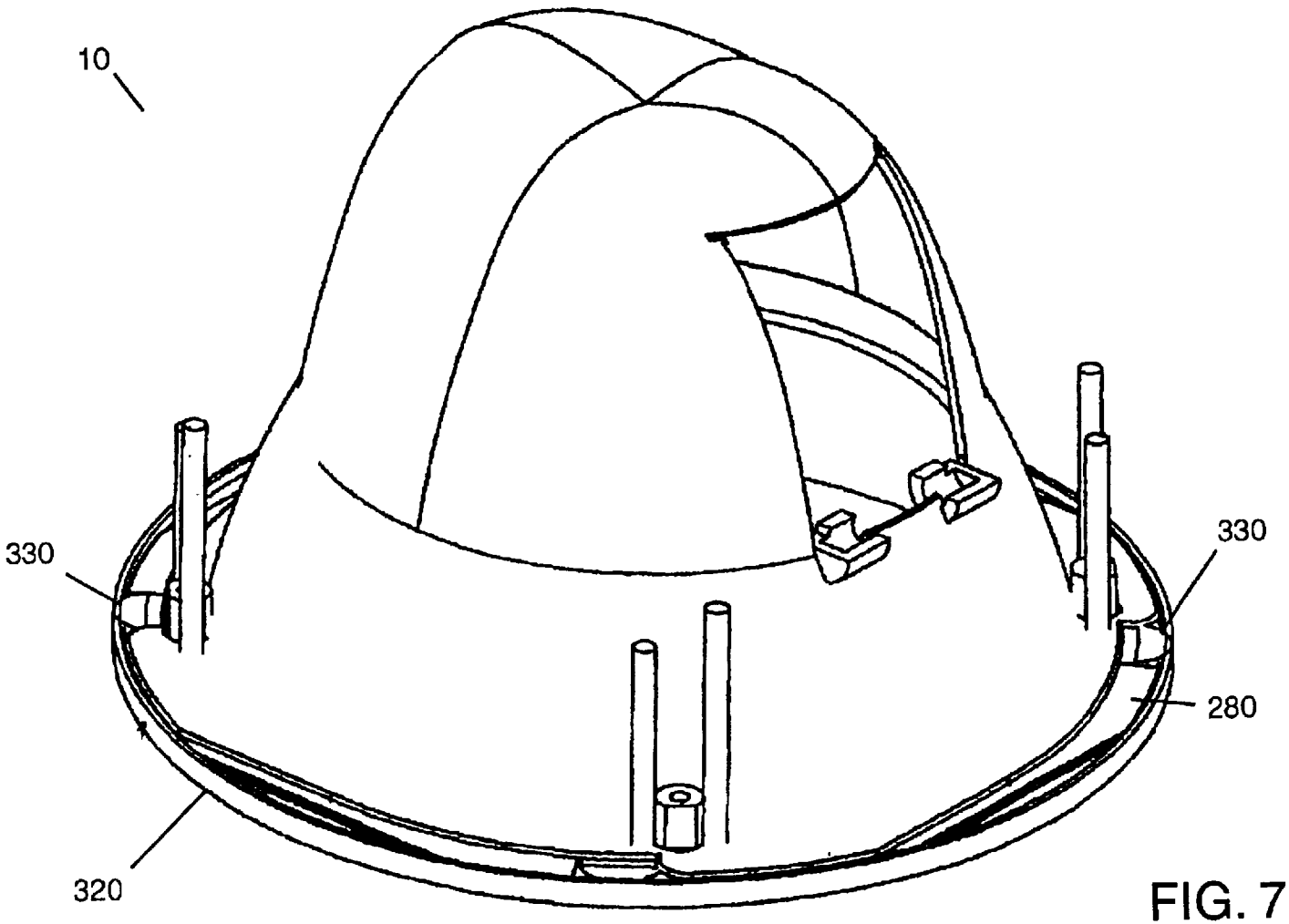
FIG. 7 shows the decorative trim engaged to the extension ring.

There is shown in FIGS. 3 and 7 the means of installing the decorative trim 320 with the extension housing flange 280 by rotating the decorative trim ring 320 so that the flange 280 engages the trim mount tabs 330, upon installation.

Figure 8:
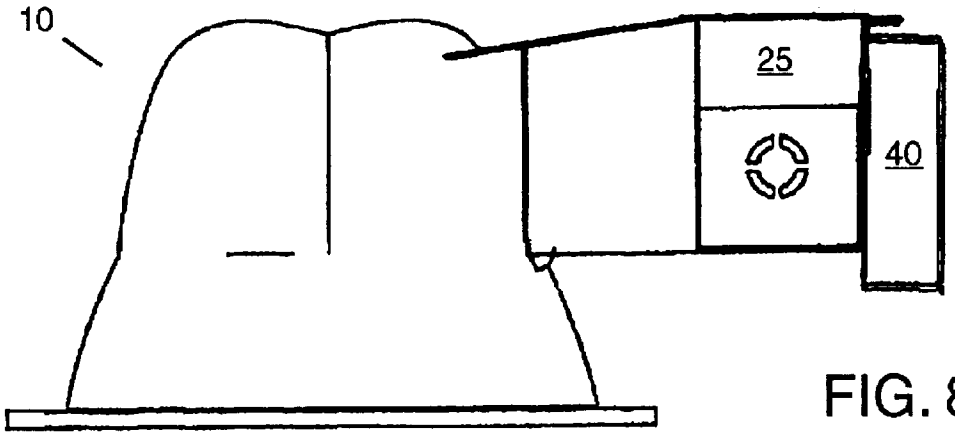
FIG. 8 shows the ballast mounted at the rear of the electrical junction box.
Figure 8A:
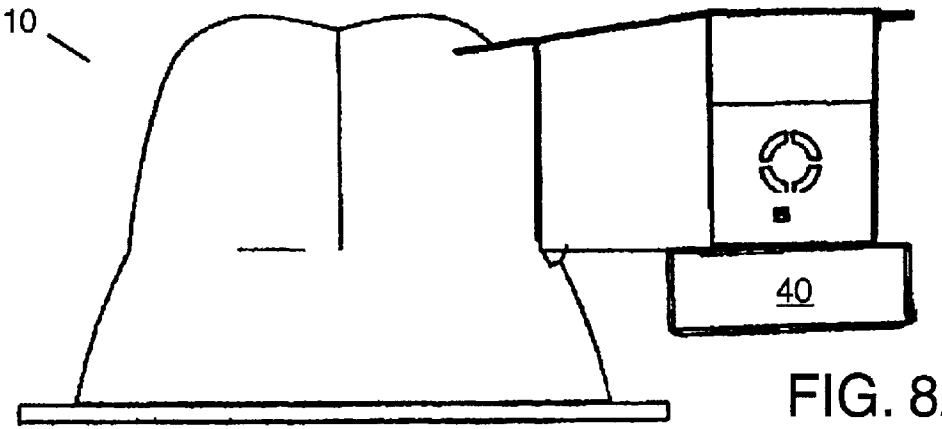
FIG. 8A shows the recessed fixture of the ballast mounted in an alternate position located beneath the electrical junction box.
Figure 9A:
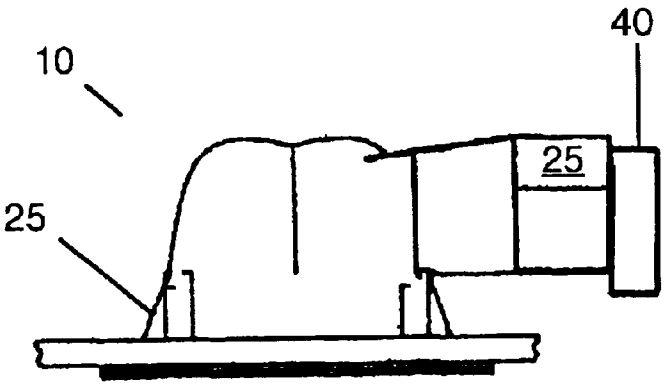
FIG. 9A shows a side view of the fixture system mounted in a typical ceiling panel.
Figure 9:
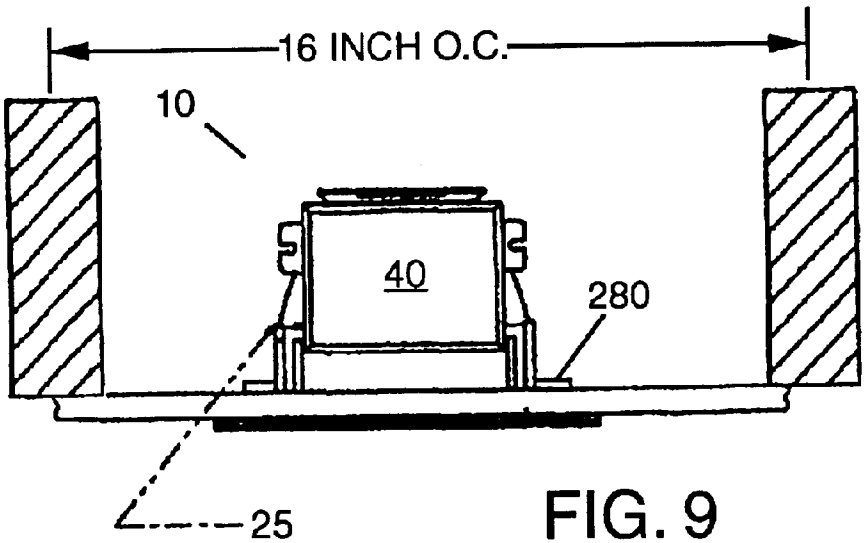
FIG. 9 shows an end view of the fixture system mounted in a ceiling panel that is installed between two joists.

As illustrated in FIG. 8, the ballast 40 is fastened to the rear of outermost edge of the electrical junction box 25 by means of threaded or push-on fasters. Alternatively, as shown in FIG. 8A, the ballast 40 may be positioned beneath the electrical junction box.

FIGS. 9, 9A, 10 and 11, best illustrate a typical installation of the recessed fixture, where the installer cuts a circular hole in the ceiling tile, centered between the joists.

The four mounting dogs 250 are attached with screws and tightened against the retainer guides 260 for shipment and installation. When the installer receives the fixture, a hole of appropriate size is drilled into the ceiling. A power wire is attached through a removable hole port 270 in FIG. 2 and connected to the ballast.

Figure 5C:
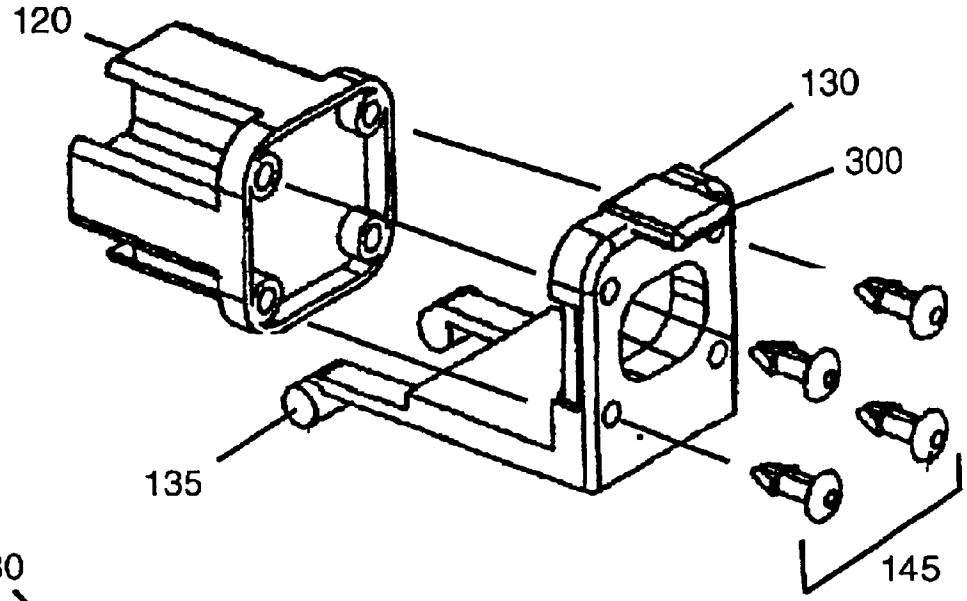
FIG. 5C is an exploded perspective drawing that details the lamp socket and lamp bracket showing the pivot point and latching means.
Figure 5A:
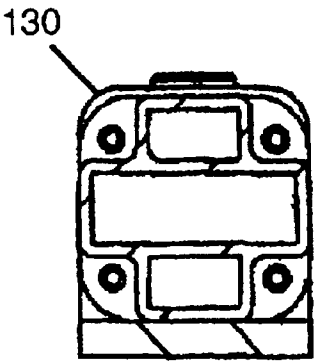
FIG. 5A is a sectional view taken along line 5A—5A of FIG. 5.
Figure 5:
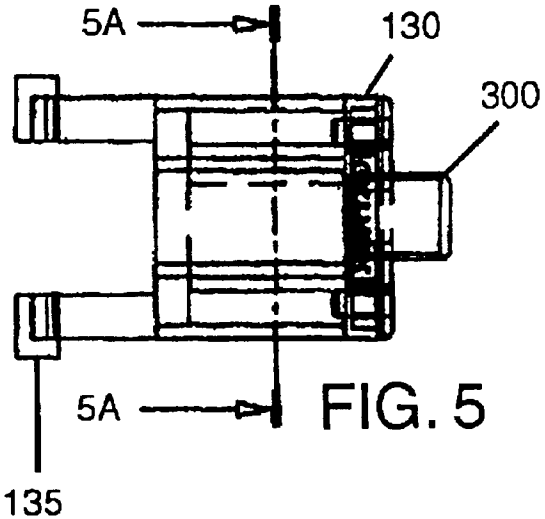
FIG. 5 is a top view of the lamp socket mounted to the lamp bracket
Figure 5B:
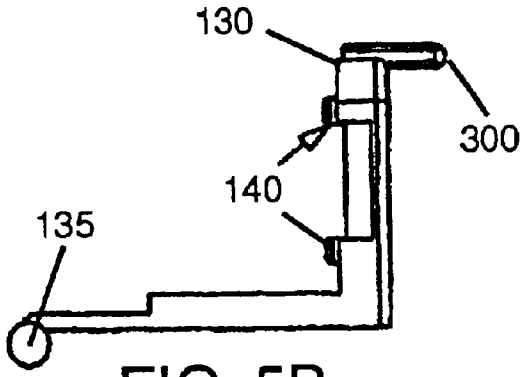
FIG. 5B is a side elevational view of the lamp bracket.

The lamp socket 120 is mounted to the lamp bracket 130 by placing it on posts 140 in FIG. 5 and deforming said posts to retain it. The wires are plugged into the lamp socket 120 the lamp bracket 130 is snapped into place in the electrical junction box 25. The air dam 150 slides into the electrical junction box 25 via slots 160 and snaps over the wires. A cover 170 which seals the can body to the air dam engages under a lip in the can 180 and mounts on several posts 190 with their associated receivers 200. The electrical junction box cover 210 is then snapped into place.

Upon completion of the wiring, the recessed fixture 10 is then pushed through the hole and the flange 280 and is seated against the ceiling surface. Each of the four screws is tightened. When each screw is tightened the mounting dogs 250 come off the retainer guides 260 due to the torque to the turning resistance. The mounting dogs 250 follow the guides 260 until they contact and secure the downlight fixture on the ceiling panel.

Figure 11:
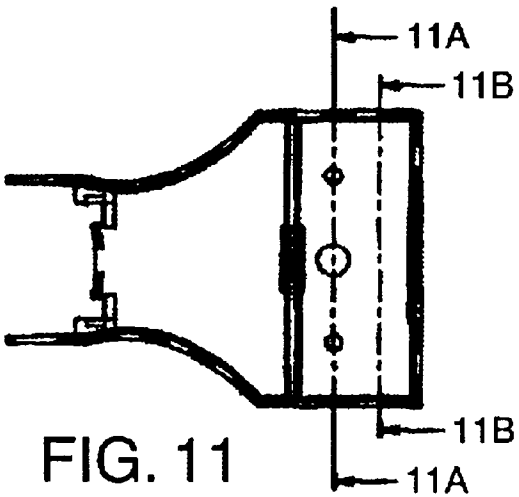
FIG. 11 is a partial top view showing the two sectional cuts of the air darn.
Figure 11D:
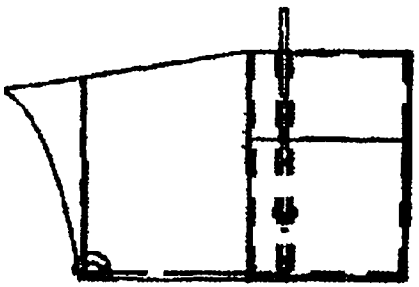
FIG. 11D is a partial side elevational view of the various details of the air dam.
Figure 11B:
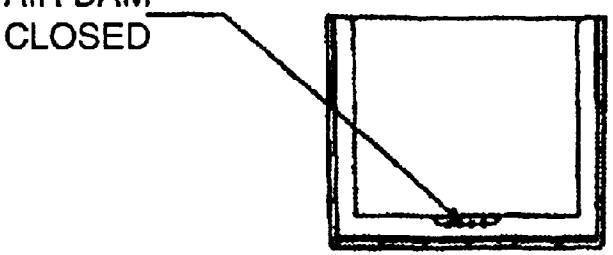
FIG. 11B is a sectional view taken along line 11B—11B of FIG. 11 showing the air dam closed.
Figure 11A:
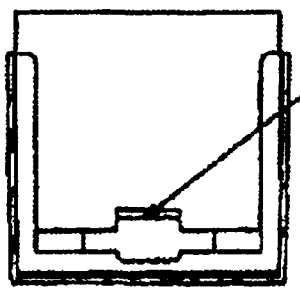
FIG. 11A is a sectional view taken along line 11A—11A of FIG. 11 showing the air dam open.

The wires 60 (not shown) are conducted into the electrical junction box through the apertures 70 and 80 or through the apertures 90 and 100 in FIG. 11. If the ballast is located in the alternate location. The wires are routed towards the lamp and retained by cavities in the junction box 110 in FIG. 11.

The lamp bracket 130 is tilted down and a lamp 290 is inserted into the lamp socket 120. The lamp bracket 130 is then returned to the horizontal position where it latches with the snap arm 300 in FIG. 5 nested into the receiver 310 in FIG. 11 on the air dam 150.

Figure 4:
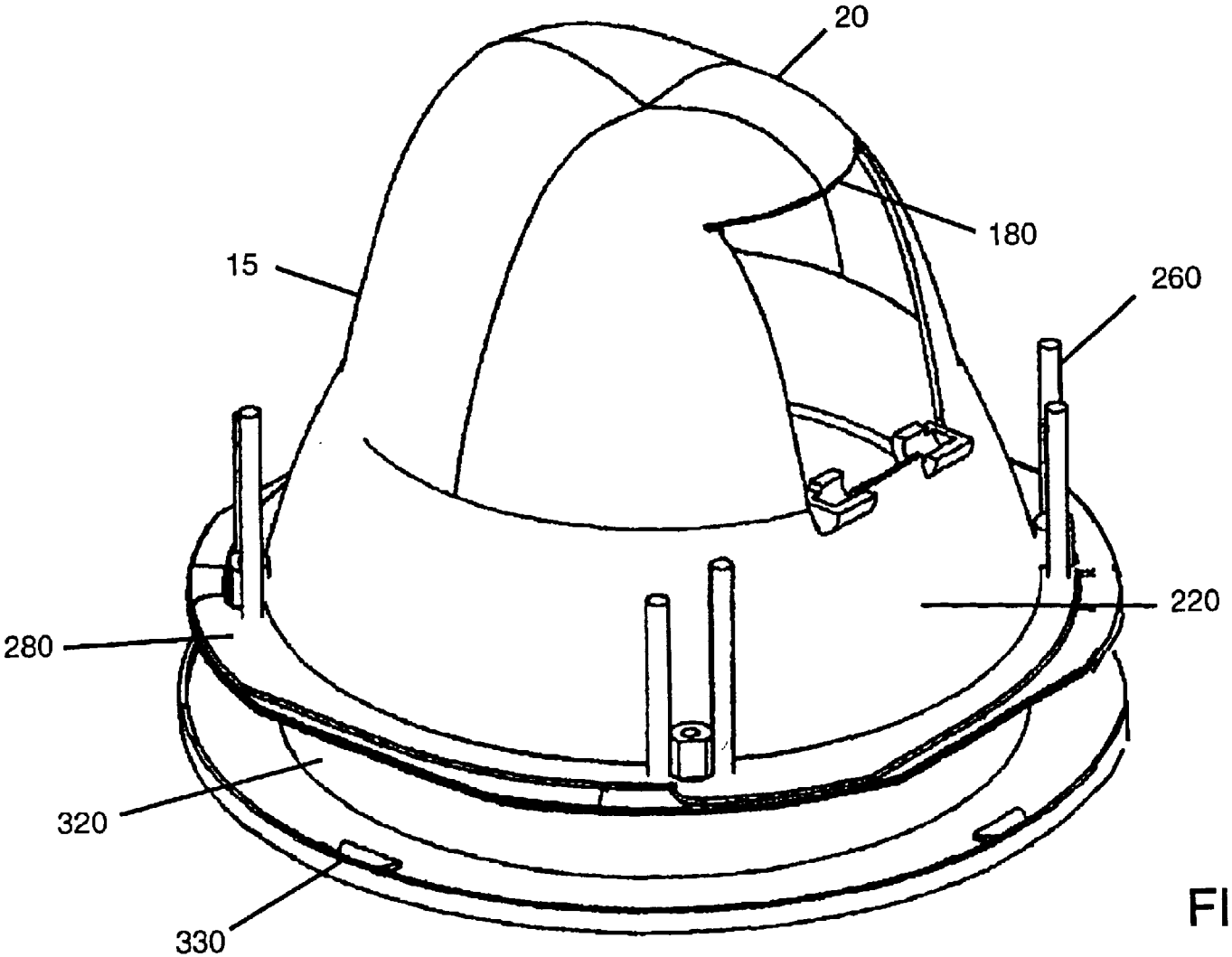
FIG. 4 details the joining means of the extension ring with the can body.
Figure 10:
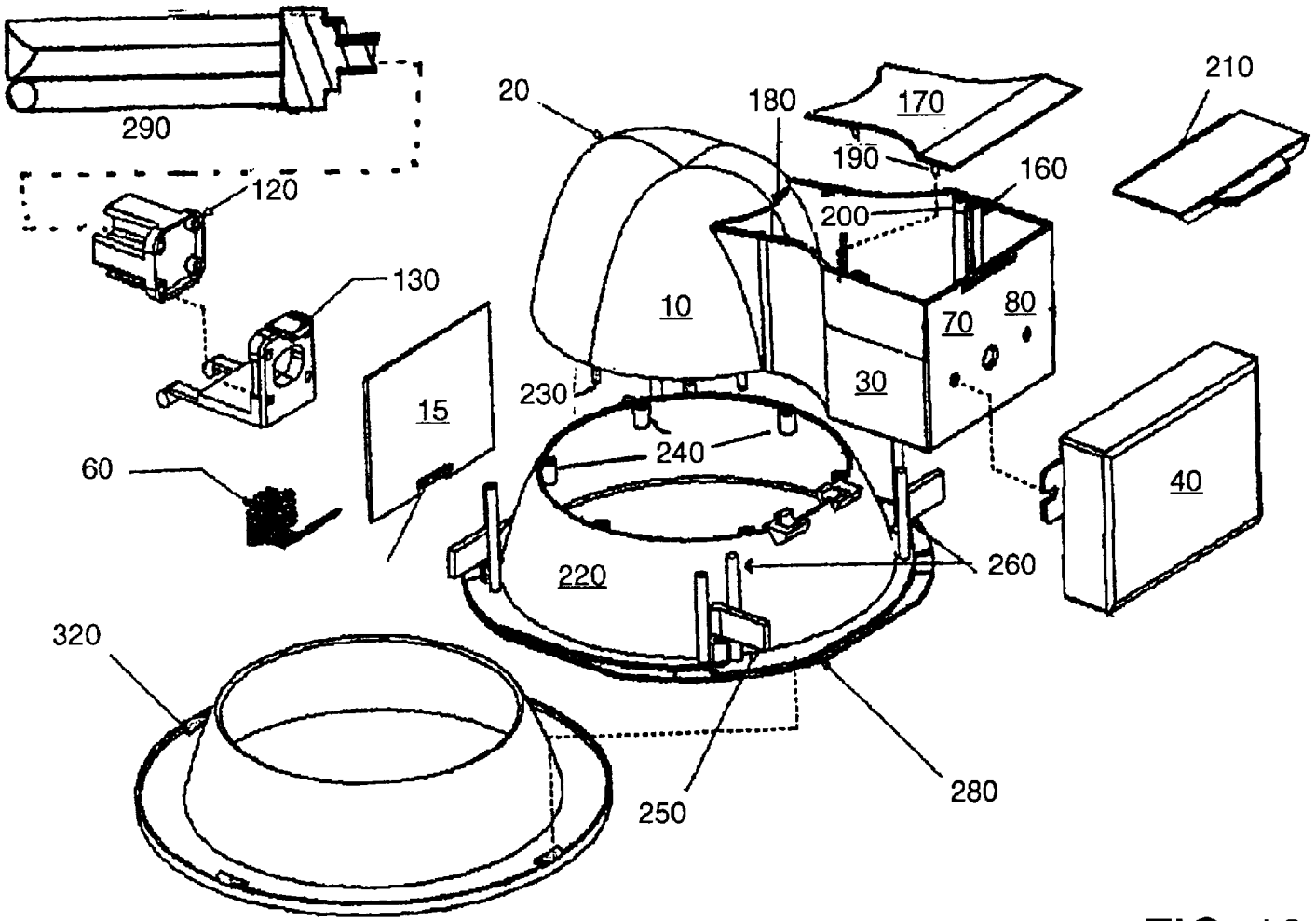
FIG. 10 is an exploded view of the preferred embodiment of the recessed fixture showing the various components

As is depicted in FIGS. 4 and 10, the trim 320 is rotatingly engaged to the flange 240 to complete the installation.

It should be understood that the preceding detailed description is for example only. There may be other modifications, deviations, and improvements that can be made without departing from the true spirit of the present invention.

What is claimed is:

1. A recessed downlight fixture comprising:

a unitized air-tight piece that is formed to have a can body with a reflector succeeded by an air dam and a junction box in a linear arrangement on a longitudinal fixture axis, and a compact fluorescent lamp having a lengthwise axis coaxial with said longitudinal axis installed within the reflector, to achieve a low profile fixture that fits within six-inch ceiling joists; and the fixture further comprising a lamp retaining means with tilting mechanism that allows disengagement from a normal operation position to a reoriented downward position to allow the user to easily remove and replace the lamp.

2. The recessed downlight fixture in accordance with claim 1, wherein the compact fluorescent lamp lies in an essentially horizontal position when the fixture is mounted in a ceiling panel.

3. The recessed downlight fixture in accordance with claim 2, wherein the fixture is fabricated of a polymeric material to eliminate air leaks and deterioration from rust and corrosion.

4. The recessed downlight fixture in accordance with claim 2, wherein the junction box supports a ballast mounted on an outer edge of the junction box, whereby the ballast is remote from the compact fluorescent lamp and a thermal generated by the lamp.

5. The recessed downlight fixture in accordance with claim 4, the reflector comprising a compound convoluted polymeric reflector system to provide a symmetrical light distribution from an asymmetrical source.

6. The recessed downlight fixture in accordance with claim 5, further comprising a decorative trim component mountable over an open end of the reflector to complete a decorative and optical system of the fixture.

7. The recessed downlight fixture in accordance with claim 6, wherein the decorative trim component includes flanges that rotatively engage corresponding flanges on the fixture body, for mounting the trim to the reflector using said flanges.

8. The recessed downlight fixture in accordance with claim 6, wherein the decorative trim component includes flexible plastic snaps which engage to recesses on the fixture body for mounting the trim to the reflector.

9. The recessed downlight fixture in accordance with claim 6, further comprising an air leakage barrier, which is received into slots in the junction box.

10. The recessed downlight fixture in accordance with claim 9, wherein the air leakage barrier includes a conduit for connection wires within said junction box.

11. The recessed downlight fixture in accordance with claim 10, further comprising a junction box cover, which is formed for access into the junction box without a requirement for fasteners.

12. A fixture comprising a recessed fluorescent downlight formed to have:

a fixture body, a reflector, and an electrical junction box, each fabricated of a polymeric material for preventing air leaks through the fixture, the reflector including a compound convoluted polymeric reflector system molded as part of the fixture which provides symmetrical light distribution from an asymmetrical source; further comprising a lamp retaining means including a means for tilting the lamp from an engaged, essentially horizontal position to a disengaged, downward oriented position, for safety in facilitating removal and replacement of the lamp, and an air dam having a removable cover, the air dam positioned between the reflector and the electrical junction box.

13. The fixture in accordance with claim 12, wherein a ballast is mounted at the rear of the electrical junction box.

14. The fixture in accordance with claim 12, wherein a ballast is mounted on an underside of the electrical junction box.

15. The fixture in accordance with claim 12, further comprising an extension ring with a plurality of boss receivers, and the reflector having a plurality of locking bosses, wherein the reflector is removably seated on the extension ring with each locking boss engaged in a respective boss receiver.

16. The fixture of claim 15, further comprising a lamp retaining assembly including a lamp socket mounted on a rotatable lamp bracket having a snap arm insertable into a receiver on the air dam cover, whereby the lamp bracket tilts downward with disengagement of the snap arm for a lamp replacement, with a return of the lamp bracket to an operative horizontal position where the snap arm is engaged into the receiver on the air dam cover to secure the bracket in the operative position.

17. The fixture in accordance with claim 16, further comprising a mounting flange with a plurality of mounting dogs of the flange each situated between a pair of retainer guides, the fixture seated on a ceiling panel by a separation of each of the dogs from its respective retainer guides by a torque to a turning resistance, and a consequent contact of each of the mounting dogs following the guides against the ceiling panel, whereby the fixture is secured to the ceiling panel.

* * * * *

UNITED STATES PATENT AND TRADEMARK OFFICE
Certificate

Patent No. 6,779,910 B1 Patented: August 24, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Bruce Pelton, Laguna Niguel, CA (US); Bruce Blady, Philadelphia, PA (US); and Bill Jones, Orange, CA (US).

Signed and Sealed this Twenty-third Day of May 2006.

SANDRA L. O'SHEA
*Supervisory Patent Examiner*
Art Unit 2875